US005820440A

United States Patent [19]

Truchsess

[11] Patent Number: 5,820,440

[45] **Date of Patent: *Oct. 13, 1998**

[54] TOY FIGURE WITH RUMP-ACTUATED SOUND GENERATOR

[75] Inventor: Joseph F. Truchsess, Ridgefield, Conn.

[73] Assignee: Pragmatic Designs, Inc., City Island, N.Y.

[ * ] Notice: The term of this patent shall not extend beyond the expiration date of Pat. No. 5,695,381.

[21] Appl. No.: 932,077

[22] Filed: Sep. 17, 1997

Related U.S. Application Data

[63] Continuation-in-part of Ser. No. 708,211, Sep. 6, 1996, Pat. No. 5,695,381.

[51] Int. Cl.[6] ..... A63H 3/24; A63H 3/28

[52] U.S. Cl. ..... 446/305; 446/297; 446/302; 446/304

[58] Field of Search ..... 446/297, 298, 446/299, 300, 301, 302, 303, 397, 484, 175, 304, 305

[56] References Cited

U.S. PATENT DOCUMENTS

| | | | |
|---|---|---|---|
| 3,490,170 | 1/1970 | Wolf | 446/305 |
| 3,504,455 | 4/1970 | Gardel et al. . | |
| 3,755,960 | 9/1973 | Tepper et al. | 446/299 |
| 4,237,647 | 12/1980 | Shaw . | |
| 4,451,911 | 5/1984 | Klose et al. | 446/303 X |
| 4,516,950 | 5/1985 | Berman et al. | 446/327 X |
| 4,799,171 | 1/1989 | Cummings | 446/175 X |
| 4,809,335 | 2/1989 | Rumsey . | |
| 4,810,997 | 3/1989 | Kudo et al. . | |
| 4,923,428 | 5/1990 | Curran | 446/299 X |
| 5,074,820 | 12/1991 | Nakayama . | |
| 5,083,965 | 1/1992 | Mayem | 446/305 |
| 5,094,644 | 3/1992 | Kelly | 446/305 |
| 5,145,447 | 9/1992 | Goldfarb | 446/398 X |
| 5,376,038 | 12/1994 | Arad et al. | 446/297 |
| 5,468,172 | 11/1995 | Basile | 446/299 |

*Primary Examiner*—Robert A. Hafer
*Assistant Examiner*—D. Neal Muir
*Attorney, Agent, or Firm*—Cohen, Pontani, Lieberman & Pavane

[57] ABSTRACT

A toy doll or bear that laughs or sings a nursery song when bounced or dandled is disclosed. A particular area on the rump of the doll is pressure sensitive and produces the given sound when a pressure level is detected in that particular area that is within a range of pressure levels produced when the doll's rump contacts the child's knee in a gentle bounce. In an alternative embodiment, electrically conductive sensors are provided on the rump area of the doll to detect when the doll's rump is wet. Tapping one of the bear's knees selects a respective song and controls the sound generator's mode of operation.

6 Claims, 4 Drawing Sheets

TOY FIGURE WITH RUMP-ACTUATED SOUND GENERATOR

CROSS-REFERENCE TO RELATED APPLICATION

This is a continuation-in-part of U.S. patent application Ser. No. 08/708,211, filed Sep. 6, 1996, now U.S. Pat. No. 5,695,381.

BACKGROUND OF THE INVENTION

1. Field of the Invention

The present invention is related to toy figures. More particularly, the present invention is related to toy figures that generate sounds.

2. Discussion of Related Art

Baby dolls that wail or call "Mama" when they are tipped, and dolls that chatter in set phrases when a button is pushed or a string is pulled, are well known. Others respond with wails or calls to a non-specific pressure that expels air from the doll.

These conventional dolls are all actuated by actions that are uncharacteristic of the way in which infants are, or in which infants should be, handled by their brothers and sisters. Toy animals' sounds are actuated in similarly uncharacteristic ways. Pets should not be squeezed, pulled at or turned upside down by children in the manner required by the sound actuators commonly used in these toys. Thus the design of the actuation of these dolls and toy animals forms and reinforces a pattern of inconsiderate, even abusive conduct toward the imaginary playfellow they represent.

SUMMARY OF THE INVENTION

A toy figure in accordance with the present invention represents a playfellow and responds vocally to a specific contact made by the child that is characteristic of proper handling of a live playfellow. The toy figure then responds to this contact in a manner suited to that type of contact.

The toy figure has a sound generator for generating vocal sound, and a sound switch for initiating a given vocal sound from said generator. The sound switch is actuated when contact is detected by a sensor in a selected contact-sensitive area of the toy figure. The area of the toy figure selected is one where contacts with the playfellow represented by the toy figure are characteristic of proper handling of the playfellow. The vocal sounds are those that are produced by a playfellow in response to such contacts. In this way, play patterns characteristic of responsible treatment of playfellows can be formed and reinforced.

In one embodiment, the sound generator sequentially produces respective sound elements of a recitation each time the sound switch is actuated. In this way the child can learn prose, poetry or songs from the toy, as well as being entertained.

The toy figure also truncates the sounds it generates so as to respond to more rapid bouncing with a more rapid recital, or simply with a faster laugh, providing a realistically dynamic, playful response. The verisimilitude of this dynamic response also enhances the child's imaginative play experience.

In a preferred embodiment, when the sound switch is re-actuated while the sound generator is producing a sound, that sound element is interrupted and the next sound element is produced. In particular, sound elements are selected so that they remain intelligible when an end portion of each one is truncated, but also so that they provide a cohesive narrative recital when whole sound elements are produced sequentially.

Specifically, a doll having a sound generator for generating vocal sound in accordance with the preferred embodiment of the present invention initiates a given vocal sound from the sound generator in response to pressure on a given area of the doll's rump. This pressure-sensitive area is an area on the rump of the doll where contacts characteristic of bouncing or dandling an infant playfellow occur.

Alternatively, the vocal sound may be initiated from a sound generator in response to a liquid sensitive switch, contact, electrical probe, etc. located in the rump of the doll. In accordance with this embodiment of the present invention, the doll may produce a sound when its rump area becomes wet or is otherwise exposed to moisture or a liquid.

This particular playful treatment of the doll by bouncing or dandling is advantageously significant in that the child may be imaginatively drawn to identify with the doll and its happy vocal response to handling that the child enjoys now, or at least did so until recently becoming too "grown-up".

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PREFERRED EMBODIMENTS

Figure 1:
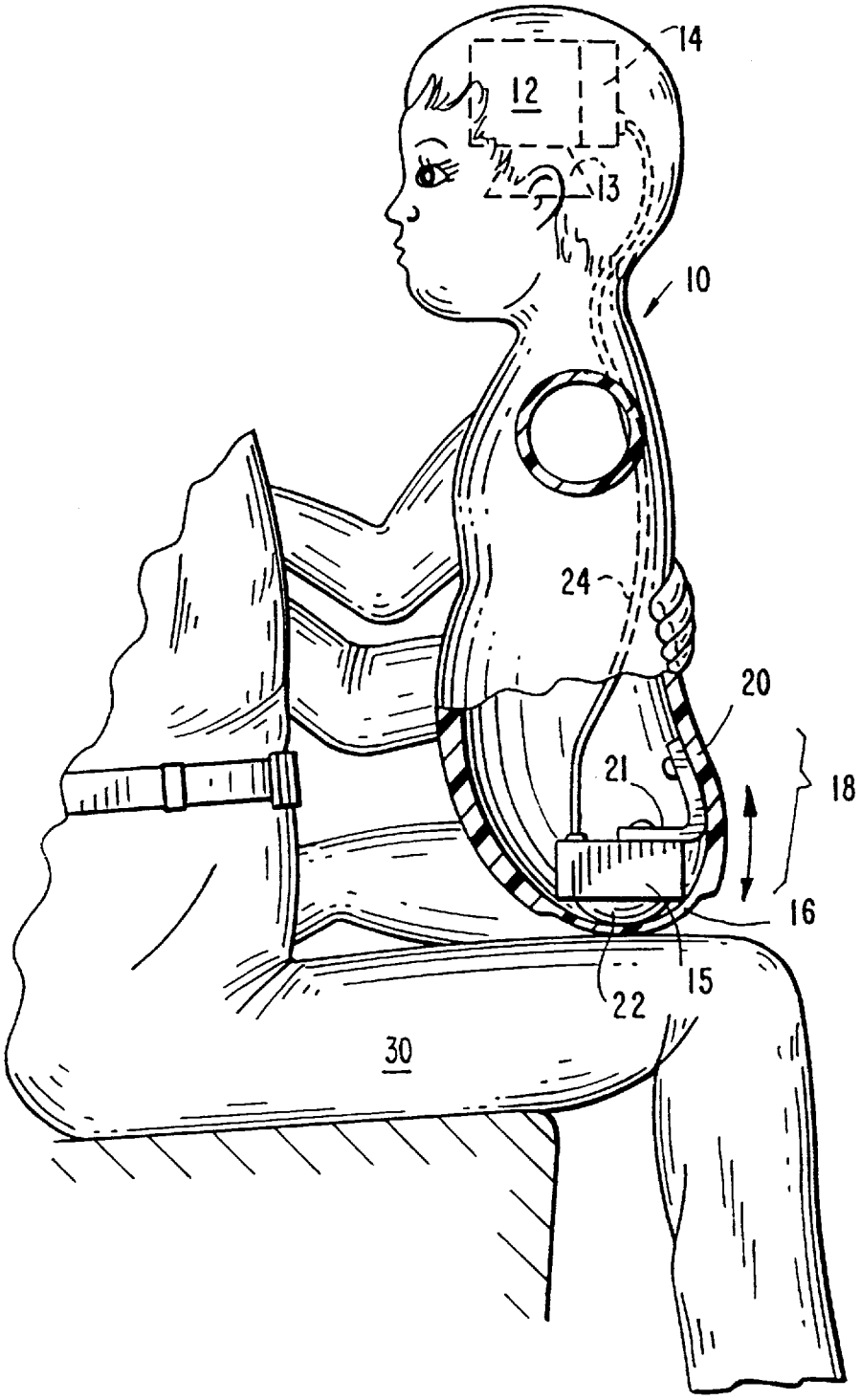
FIG. 1 is a partial cross-sectional view of a doll in accordance with a first embodiment of the present invention.

FIG. 1 shows a baby doll 10 having a sound generator 12 and speaker 13 for generating vocal sound. The sound generator "sings" a word or a sequence of words that is an element of a nursery song, or simply laughs, each time the baby doll is gently bounced or dandled on the child's knee. The sound switch 14 that initiates sound generation is actuated in a manner that is selectively responsive to that particular type of handling.

The words of the song are generated sequentially. Each element generated has an elongated phoneme and may or may not include an extra "bridging" terminal consonant that anticipates the initial consonant of the next element of the song. The phoneme portion is elongated, "drawled" out for an extended period of time, so that each element of the song remains intelligible when the end of a respective element is truncated slightly by rapid but gentle bouncing. The "bridging" consonants are provided to counteract some of the awkwardness attendant on the elongation of some phonemes by smoothing the transitions between sequential elements where possible. Thus, the elements of a simple "Bouncy Baby" song are generated as follows:

Bownnnns—seeee, bownnnns—seeee, Bayyyy—beeee Weeee

Luhhhhvs toooo bownnnns ahnnnn Mahhhhm—meeees neeee!

Wheeeeeeee!! (laughter).

(The extra terminal consonants, and the initial consonants that they extend toward, appear in bold characters here.)

Figure 2:
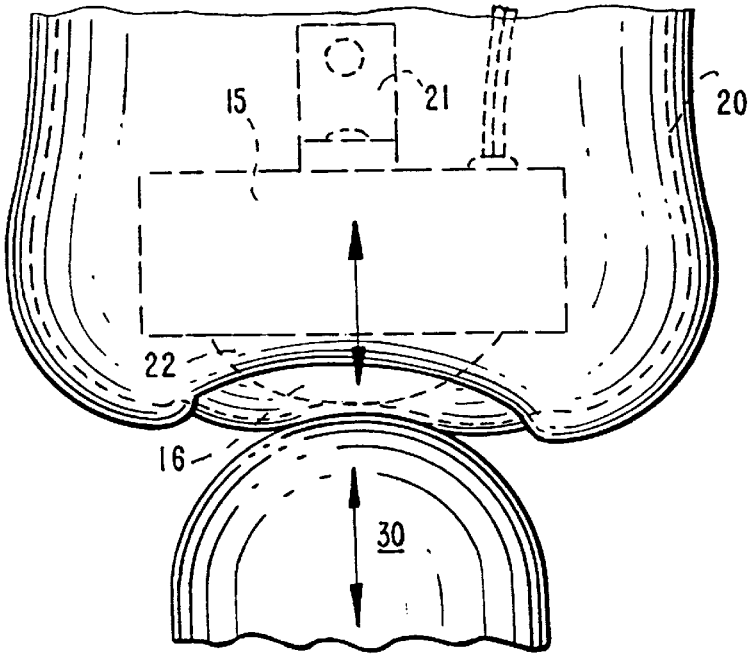
FIG. 2 is a rear-view of the doll of FIG. 1.

The sound switch 14 is actuated by a pressure sensor 15 when the pressure exerted by the momentum of the bouncing doll, which will exceed the static pressure merely produced by the weight of the doll, is detected by the sensor 15 in the thinned area 16 of the rump 18 of the doll 10, seen clearly in FIG. 2.

In this embodiment, a stiff plastic material 20 such as polypropylene forms the shell of the trunk portion of the doll 10. The pressure sensor 15 is held in place by a bracket 21 affixed to that stiff wall 20. In the thinned portion 16, however, the material of the shell 20 is elastically deformable so as to permit the detector element 22 of the sensor 15 to be displaced. On the other hand, adjacent areas of the doll's shell 20 are sufficiently stiff so that pressure applied to these adjacent areas does not actuate the pressure sensor 15.

To discourage rough handling of the doll 10, the vocal response might possibly be pressure-limited, so that the sensor 15 responds to excessive force by sending a signal over the connecting wires 24 to the sound switch 14 in the doll's head that interrupts the sound being produced by the sound generator 12. Thus, only suitable pressure on the thinned area 16 produces the desired sound.

The pressure-thresholds for the sensor 15 are selected so that merely sitting the doll down or the sort of rough play that abuses the doll, at the other extreme, does not produce a pressure level that can actuate the generator 12. Thus, in lieu of a real playfellow, the bouncy baby doll 10 can provide entertaining, constructive and creative play that encourages self-control.

Furthermore, the thinned area 16 is selected so that the pressure level necessary for sound actuation reliably occurs when the doll's rump 18 contacts the child's lap or knee 30 during gentle bouncing or dandling suitable for an infant playfellow. It might be possible to implement this vocal response using a momentum sensor for this purpose, but the response of conventional momentum sensors useful for this purpose is less reliable, and would be less easily limited to exclude rough play.

Figure 3:
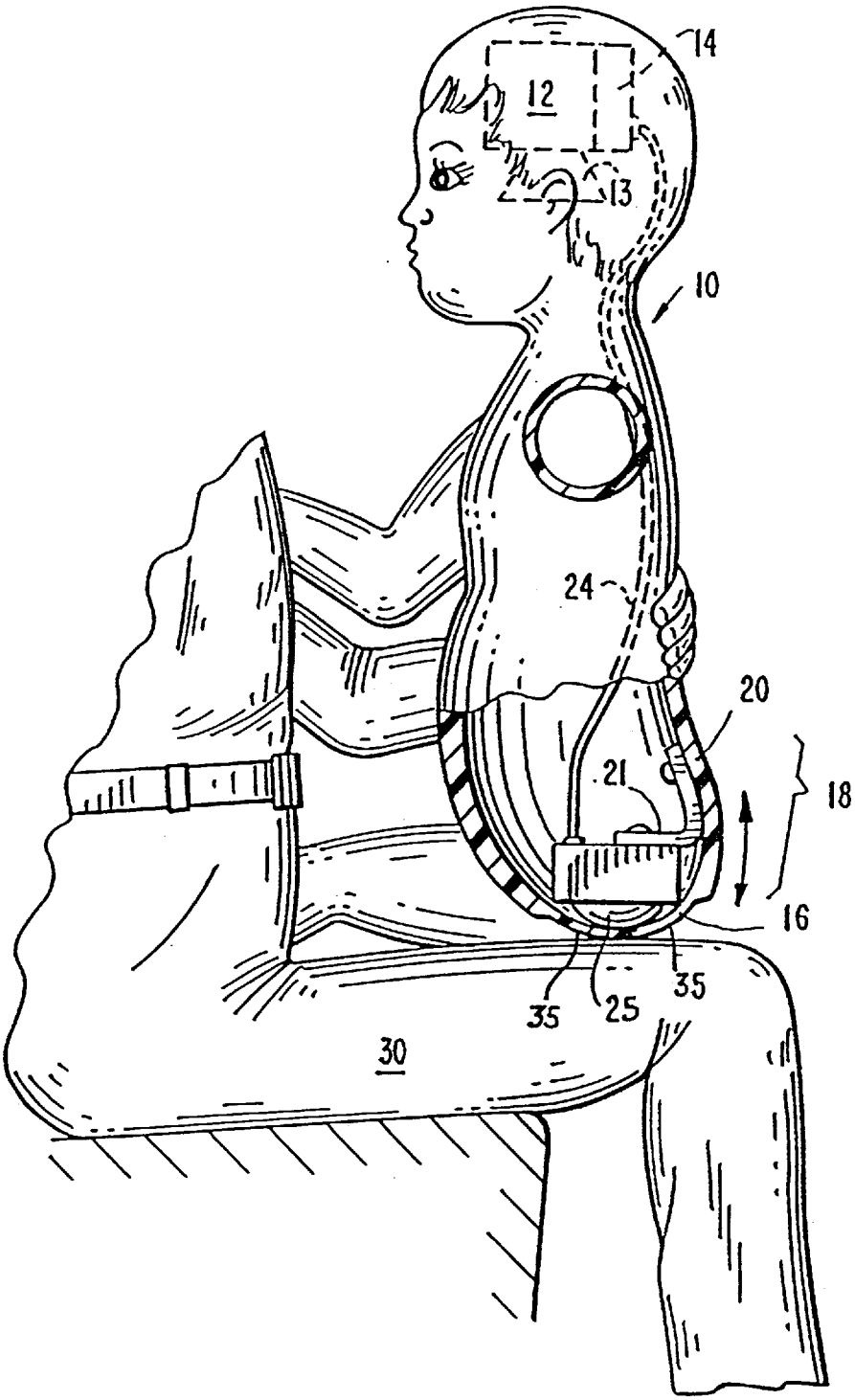
FIG. 3 is a partial cross-sectional view of a doll in accordance with an alternative embodiment of the present invention.
Figure 4:
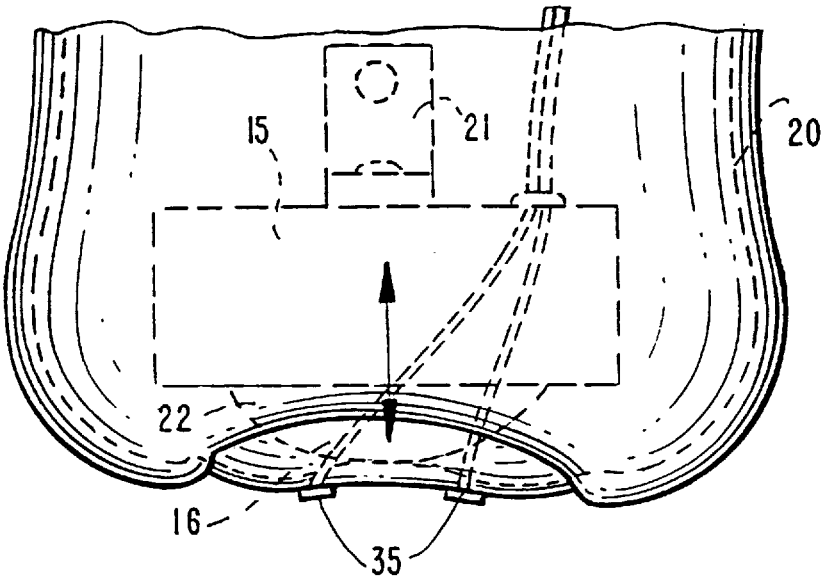
FIG. 4 is a rear view of the doll of FIG. 3.

Referring next to FIGS. 3 and 4, an alternative embodiment of the present invention includes a moisture sensor 25 located in the rump area 18 that may actuate the sound switch 14 when the rump area 18 of the doll 10 is exposed to a liquid or otherwise becomes damp, wet, etc.

The sensor 25 may be secured within the rump 18 of the doll 10 by a bracket 21 or by other known fastening or securing means and is preferably configured as two electrically conductive contacts 35 (FIG. 4) that are at least partly exposed near or at the rump area 18.

Closure of the sound switch 14 is effected when the contacts 35 are exposed to or placed in a liquid such as, for example, water, or when the contacts 35 are otherwise caused to be wet, damp, etc., such that an electrical circuit or current path is created between the contacts 35. When so exposed, the electrical circuit comprising the contacts 35, sound switch 14, sound generator 12 and speaker 13 is completed and the doll 10 may generate a vocal sound. By repeatedly exposing the contacts 35 to a liquid, e.g., by placing or dipping the rump 18 of the doll 10 in water, the doll 10 may be caused to generate sequential sounds in the manner described hereinabove and with reference to FIGS. 1 and 2. Thus, in accordance with the embodiment depicted in FIGS. 3 and 4, the inventive doll 10 may be caused to generate a vocal sound when, for example, the doll's rump 18 is wet—simulating a wet diaper, wet pants, a child taking a bath, and the like. Such a doll may be useful, for example, in the toilet-training of a child.

Figure 5:
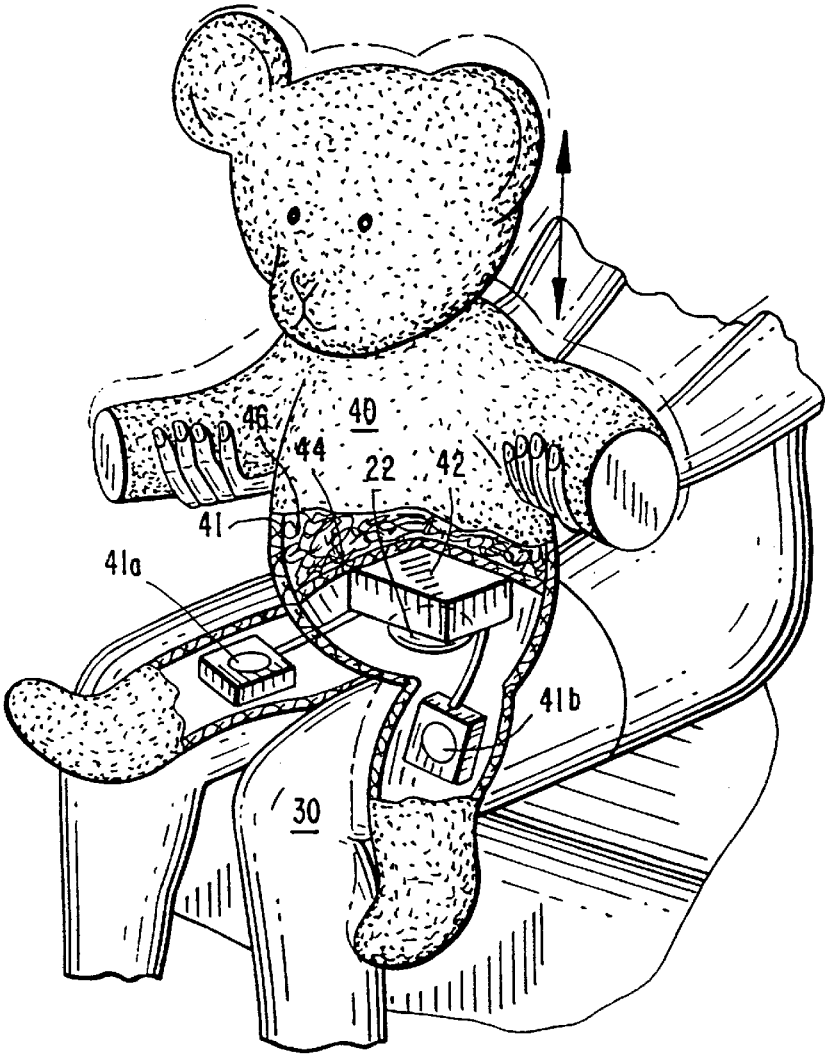
FIG. 5 is a perspective view of a plush bear in accordance with a further embodiment of the present invention.

In a further alternative embodiment shown in FIG. 5, the toy figure is a stuffed plush teddy bear 40 having a soft, flexible cloth shell 41. In this embodiment, the speaker, sound generator and sound switch are included with the sensor and its detector element 22, in a single sound unit 42. This single unit 42 provides a lower center of gravity for the toy figure and is less expensive to produce and install than the sound system of FIG. 1, but having the speaker 13 in the figure's head may provide a more realistic sound.

The sound unit 42 in FIG. 5 also has a pair of auxiliary sing mode switches 41*a*, 41*b* that the child actuates by tapping the bear's knee. The first actuation of the right knee switch 41*a* starts the "sing" mode that plays all elements of the "Bouncy Baby" song in sequence, from beginning to end. Actuation of the rump switch during the song triggers a "pause" mode that interrupts the "Bouncy Baby" song. If the right knee switch 41*a* is tapped again, a second time, within 15 seconds of the start of the pause mode, the sound unit will resume singing the "Bouncy Baby" song where it left off. If the detector element 22 in the doll's rump 18 is actuated during that 15-second period, the sound unit 42 will resume producing elements of the "Bouncy Baby" for each actuation where it left off from the song. Conversely, it resumes its sing-mode singing of the song, starting with the next sequential element of the song, if the right knee switch 41*a* is subsequently tapped again before the 15-second grace period after the last bounce-actuation of the sound unit 42 has expired. Tapping the left-knee switch provides the same sing/pause/bounce mode selection options for another song, "I Love Mommy" for example:

Ayyyy luhhhhv Mahhhhm—meeee. Mahhhhm—meeee seeee . . .

Preferably the second song uses many of the same elements, for the sake of simplicity.

The "Bouncy Baby" song is automatically reset to the beginning of that song 15 seconds after the pause mode starts, unless the detector element 22 on the rump 18 or the right knee switch is actuated. Thus the song begins at its beginning again after the child's attention has been distracted long enough for the child to forget the rest of the song.

The sound unit 42 shown in FIG. 5 may be held against the bear's cloth shell 41 by a cloth barrier 44 sewn into the shell 41. The cloth barrier 44 prevents the sound unit 42 from migrating up into the bear's stuffing 46, where actuation of the detector element 22 might become less reliable. The cloth barrier may also help to prevent pressures applied in adjacent areas of the cloth shell 41 from affecting the sensor 15 by encircling the area 16, so as to draw the cloth together, making that given area 16 of the cloth 41 looser and more freely movable. The unit 42 may then be held in place only by stuffing.

The batteries (not shown) inside the sound unit 42 are changed through an access flap (not shown) in the shell 41 on the back of the bear 40 that is secured by hook-and-loop fastener tapes. To conserve battery power, the sound unit 42 provides a sleep mode that cuts power usage 15 seconds after the last-actuated sound event is complete. While the bear is in the sleep mode, the next actuation of the sound unit by the detector element 22, or knee switches 41*a*, 41*b*, returns the sound unit 42 to its fully-powered, active state.

In this way, play patterns characteristic of responsible treatment of playfellows can be formed and reinforced. Also, the verisimilitude of the toy figure's response enhances the child's imaginative play experience. In particular, playful bouncing or dandling of the doll is advantageously significant because the child is likely to be imaginatively drawn to identify with the doll and its song, as the doll's happy vocal response to treatment that the child also enjoys now—or at least did enjoy recently, before becoming too "grown-up".

The invention has been described with particular reference to a presently preferred embodiment of the invention. However, it will be immediately apparent to one skilled in the art that variations and modifications thereof are possible within the spirit and scope of the present invention. For example, the toy figure could be a plush teddy bear or suitable contact might be detected by other touch-sensitive means, such as a time-limited ground-capacitance sensor.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve substantially the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A child's toy comprising:

a toy figure representing a child's playfellow, said toy figure including a first contact switch located in a first predefined area of a rump of said toy figure and positioned to contact a liquid when said first predefined rump area is selectively exposed to the liquid to simulate a wetting of said first predefined rump area, said contact switch being actuated each time said first predefined rump area is exposed to the liquid during said wetting simulation; and a sound generator for storing a sequence of sound elements that, when sequentially generated, form a sound recitation, said sound generator being connected to said first contact switch for generating a sound element of said sequence of sound elements in response to actuation of said first contact switch during said wetting simulation, said first contact switch causing said sound generator to produce a first sound element of said sequence of sound elements when said first contact switch is first actuated, and wherein upon each subsequent actuation of said first contact switch said first contact switch causes said sound generator to responsively generate a subsequent sequential sound element of said sequence of sound elements thereby producing said sound recitation upon repeated actuation of said contact switch during said wetting simulation of exposing said first predefined rump area to the liquid, so as to entertain by said sound recitation a child playing with said toy figure by repeatedly exposing said first predefined rump area to the liquid during said simulated wetting.

2. The child's toy of claim 1, wherein said first contact switch further comprises two electrically conductive contacts.

3. The child's toy of claim 1, wherein after said sound generator generates a last sound element of said sequence of sound elements, said sound generator is reset such that upon the next actuation of said first contact switch during said simulated wetting, said sound generator re-starts said sequence of sound elements by generating said first sound element of said sequence of sound elements.

4. The child's toy of claim 1, said sound generator being configured so that when said first contact switch is actuated during said simulated wetting while said sound generator is generating a one of the sound elements of said sequence of sound elements, said sound generator truncates said one generated sound element, and wherein said sequence of sound elements is selected such that each sound element remains intelligible when it is truncated.

5. The child's toy of claim 1, further comprising a plurality of sequences of sound elements, and a second contact switch positioned in a second predefined area of said toy figure and connected to said sound generator for selecting, in response to contact with said second predefined area, a particular sequence of sound elements from said plurality of sequences of sound elements for generation by said sound generator in response to actuation of said first contact switch during said simulated wetting.

6. The child's toy of claim 1, wherein at least one said sound element of said sequence of sound elements is one of a word, a song portion, and a musical piece.

* * * * *